US011583002B2

(12) United States Patent
Zhu

(10) Patent No.: US 11,583,002 B2
(45) Date of Patent: Feb. 21, 2023

(54) ELECTRONIC CIGARETTES HAVING VAPORIZERS WITH U SHAPED AIR PATH AND METHODS OF USING THE SAME

(71) Applicant: SHENZHEN SMACO TECHNOLOGY LIMITED CORPORATION, Shenzhen (CN)

(72) Inventor: Xiaochun Zhu, Shenzhen (CN)

(73) Assignee: SHENZHEN SMACO TECHNOLOGY LIMITED CORPORATION, Shenzhen (CN)

( * ) Notice: Subject to any disclaimer, the term of this patent is extended or adjusted under 35 U.S.C. 154(b) by 475 days.

(21) Appl. No.: 16/801,799

(22) Filed: Feb. 26, 2020

(65) Prior Publication Data

US 2020/0367558 A1 Nov. 26, 2020

(51) Int. Cl.

| | |
|---|---|
| ***A24F 40/42*** | (2020.01) |
| ***A24F 40/51*** | (2020.01) |
| ***A24F 40/57*** | (2020.01) |
| ***H05B 3/10*** | (2006.01) |
| ***A24F 40/10*** | (2020.01) |
| ***H05B 1/02*** | (2006.01) |
| ***A24F 40/46*** | (2020.01) |

(52) U.S. Cl.

CPC ..... *A24F 40/42* (2020.01); *A24F 40/10* (2020.01); *A24F 40/46* (2020.01); *A24F 40/51* (2020.01); *A24F 40/57* (2020.01); *H05B 1/0202* (2013.01); *H05B 1/0297* (2013.01); *H05B 3/10* (2013.01)

(58) Field of Classification Search

CPC ..... A24F 40/10; A24F 40/40; A24F 40/20; A24F 40/46; A24F 40/51; H05B 1/0202

See application file for complete search history.

(56) References Cited

U.S. PATENT DOCUMENTS

| | | | | |
|---|---|---|---|---|
| 11,297,881 | B2 * | 4/2022 | Qiu | A24F 40/48 |
| 2016/0135505 | A1 * | 5/2016 | Li | A24F 40/46 131/329 |
| 2020/0288778 | A1 * | 9/2020 | Kim | G02B 19/0009 |
| 2020/0345066 | A1 * | 11/2020 | Kim | A24F 40/485 |

* cited by examiner

*Primary Examiner* — Hae Moon Hyeon

(57) ABSTRACT

The present disclosure relates to electronic cigarettes having vaporizer assembly with "U" shaped air path and methods of using the same. The electronic cigarette includes: mouthpiece assembly, electronic cigarette body, E-liquid storage tank having a negative air pressure cavity and a number of airflow channels forming "U" shaped air path, and the vaporizer assembly. The vaporizer assembly includes: one or more cylindrical E-liquid storage media, and one or more heating elements. The elements are electrically connected to an electrical power supply through negative air pressure activated switch. When a user sucks air from mouthpiece assembly, a negative air pressure is created in the negative air pressure cavity, the negative air pressure activated switch turns on the electrical power supply to the heating elements, and the heating elements vaporize the E-liquid stored in cylindrical E-liquid storage media to generate electronic cigarette vapor for the user through the "U" shaped air path.

20 Claims, 7 Drawing Sheets

ELECTRONIC CIGARETTES HAVING VAPORIZERS WITH U SHAPED AIR PATH AND METHODS OF USING THE SAME

FIELD

The present disclosure generally relates to the field of electronic cigarette, and more particularly to vaporizers having a "U" shaped air path, electronic cigarettes having the vaporizers with "U" shaped air path, and methods of using the electronic cigarettes having the vaporizers with "U" shaped air path.

BACKGROUND

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Conventional electronic cigarettes have vertical vaporizer allowing vapor to go from the vaporizer to mouthpiece upwards. When the electronic cigarette is not in use, condensation of moist and vapor inside the vaporizer may be accumulated at the bottom of the vaporizer. Such condensed water or E-liquid debris accumulated at the bottom of the vaporizer may deteriorate the performance of the vaporizer, and cause short circuit of the heating elements and/or electrical power supply. It is desirable that the electronic cigarette has an ability to prevent the condensed water from getting into or near electronic circuit, switch, and electrical power supply.

Therefore, an unaddressed need exists in the art to address the aforementioned deficiencies and inadequacies.

SUMMARY

In one aspect, the present disclosure relates to a vaporizer assembly having a "U" shaped air path. In certain embodiments, the vaporizer assembly includes: an E-liquid storage tank, one or more cylindrical E-liquid storage media, and one or more heating elements. The E-liquid storage tank includes: an E-liquid storage cavity, a negative air pressure cavity, and a predetermined number of airflow channels. The E-liquid storage cavity stores E-liquid for an electronic cigarette. The predetermined number of airflow channels form the "U" shaped air path outside of the E-liquid storage cavity.

In certain embodiments, the one or more cylindrical E-liquid storage media receives and stores E-liquid from the E-liquid storage cavity. The one or more heating elements are in direct contact with interior surface of the one or more cylindrical E-liquid storage media to heat the E-liquid received from the E-liquid storage tank. The one or more heating elements are electrically connected to an electrical power supply through a negative air pressure activated switch.

In certain embodiments, when a negative air pressure is created in the negative air pressure cavity, the negative air pressure activated switch turns on the electrical power supply to the one or more heating elements, and the one or more heating elements vaporize the E-liquid stored in the one or more cylindrical E-liquid storage media, and deliver vaporized E-liquid to the user through the "U" shaped air path.

In certain embodiments, the "U" shaped air path includes: a first air intake opening, a second air intake opening, a first airflow channel, a second airflow channel, a third airflow channel, and a fourth airflow channel. The first air intake opening is defined on a first side wall of an electronic cigarette body. The second air intake opening is defined on a first side wall of the E-liquid storage tank. The first airflow channel is positioned on the first side wall of the E-liquid storage tank. A first end of the first airflow channel meets the first air intake opening, the second air intake opening, and the negative air pressure cavity. The second airflow channel is positioned along the one or more cylindrical E-liquid storage media. A first end of the second airflow channel meets a second end of the first airflow channel. The third airflow channel is positioned on an opposite second side of the E-liquid storage tank. A first end of the third airflow channel meets a second end of the second airflow channel. The fourth airflow channel is positioned on a second end of the third airflow channel and a top end of the second side of the E-liquid storage tank. A second end of the fourth airflow channel connects to a mouthpiece air chamber and an air path of a mouthpiece assembly through a mouthpiece air chamber.

In certain embodiments, each of the one or more heating elements includes a positive terminal and a negative terminal. The positive terminal of the one or more heating elements is electrically connected to a positive terminal of the electrical power supply through the negative air pressure activated switch. Each of the negative terminals of the one or more heating elements is electrically connected to a negative terminal of the electrical power supply.

In certain embodiments, each of the one or more heating elements includes at least one of: aluminum (Al), Chromium (Cr), Manganese (Mn), Iron (Fe), Cobalt (Co), Nickel (Ni), Copper (Cu), Zirconium (Zr), Niobium (Nb), Molybdenum (Mo), Rhenium (Re), Silver (Ag), Cadmium (Cd), Tantalum (Ta), Tungsten (W), Iridium (Ir), Platinum (Pt), Gold (Au), and alloys of these materials.

In certain embodiments, each of the one or more heating elements includes at least one of: a grid shaped heating element, a mesh shaped heating element, a net shaped heating element, a spiral heating element, and any combination of these heating elements.

In certain embodiments, each of the one or more cylindrical E-liquid storage media includes at least one of: cotton fibers, polypropylene fibers, terylene fibers, nylon fibers, porous ceramic materials, and any combination of these materials.

In another aspect, the present disclosure relates to an electronic cigarette. In certain embodiments, the electronic cigarette includes: a mouthpiece assembly, an electronic cigarette body, an E-liquid storage tank, and a vaporizer assembly having a "U" shaped air path. The electronic cigarette body includes a top end, a bottom end and a first air intake opening defined on a first side wall of the electronic cigarette body. The mouthpiece assembly is positioned on the top end of the electronic cigarette body. The E-liquid storage tank is positioned inside of the electronic cigarette body. The E-liquid storage tank includes: an E-liquid storage cavity, a negative air pressure cavity, and a predetermined number of airflow channels. The E-liquid storage cavity stores E-liquid. The predetermined number of airflow channels form the "U" shaped air path outside of the E-liquid storage cavity.

In certain embodiments, the vaporizer assembly includes: one or more cylindrical E-liquid storage media, and one or more heating elements. The one or more cylindrical E-liquid storage media receive and store E-liquid from the E-liquid storage cavity. The one or more heating elements are in direct contact with interior surface of the one or more cylindrical E-liquid storage media to heat the E-liquid received from the E-liquid storage cavity. The one or more heating elements are electrically connected to an electrical power supply through a negative air pressure activated switch.

In certain embodiments, when a user sucks air from the mouthpiece assembly, a negative air pressure is created in the negative air pressure cavity, the negative air pressure activated switch turns on the electrical power supply to the one or more heating elements, and the one or more heating elements vaporize the E-liquid stored in the one or more cylindrical E-liquid storage media to generate electronic cigarette vapor for the user through the "U" shaped air path.

In certain embodiments, each of the one or more heating elements includes a positive terminal and a negative terminal. Each of the positive terminals of the one or more heating elements is electrically connected to a positive terminal of the electrical power supply through the negative air pressure activated switch, and each of the negative terminals of the one or more heating elements is electrically connected to a negative terminal of the electrical power supply, respectively.

In certain embodiments, the "U" shaped air path includes: the first air intake opening, a second air intake opening, a first airflow channel, a second airflow channel, a third airflow channel, and a fourth airflow channel. The first air intake opening is defined on the first side wall of the electronic cigarette body. The second air intake opening is defined on a first side wall of the E-liquid storage tank. The first airflow channel is positioned on the first side wall of the E-liquid storage tank. A first end of the first airflow channel meets the first air intake opening, the second air intake opening, and the negative air pressure cavity. The second airflow channel is positioned along the one or more cylindrical E-liquid storage media. A first end of the second airflow channel meets a second end of the first airflow channel. The third airflow channel is positioned on an opposite second side of the E-liquid storage tank. A first end of the third airflow channel meets a second end of the second airflow channel. The fourth airflow channel is positioned on a second end of the third airflow channel and a top end of the second side of the E-liquid storage tank. A second end of the fourth airflow channel connects to a mouthpiece air chamber and an air path of the mouthpiece assembly through a mouthpiece air chamber.

In certain embodiments, the mouthpiece assembly includes: the air path, a predetermined number of first mouthpiece connectors, a mouthpiece sealing element, and the mouthpiece air chamber. The air path is positioned inside of the mouthpiece assembly and connects to the "U" shaped air path through the fourth airflow channel in the mouthpiece air chamber for the user to enjoy vaporized E-liquid. The predetermined number of first mouthpiece connectors connect the mouthpiece assembly to the E-liquid storage tank. The mouthpiece sealing element is positioned between the mouthpiece assembly and the E-liquid storage tank to prevent vaporized E-liquid from leaking out of the "U" shaped air path.

In certain embodiments, the E-liquid storage tank includes: a top end, a bottom end, and a predetermined number of second mouthpiece connectors. The predetermined number of second mouthpiece connectors are positioned on the top end of the E-liquid storage tank. In certain embodiments, the number of second mouthpiece connectors corresponds to the number of first mouthpiece connectors and each of the second mouthpiece connectors is connected to a corresponding second mouthpiece connector of the mouthpiece assembly.

In certain embodiments, each of the one or more heating elements includes at least one of: aluminum (Al), Chromium (Cr), Manganese (Mn), Iron (Fe), Cobalt (Co), Nickel (Ni), Copper (Cu), Zirconium (Zr), Niobium (Nb), Molybdenum (Mo), Rhenium (Re), Silver (Ag), Cadmium (Cd), Tantalum (Ta), Tungsten (W), Iridium (Ir), Platinum (Pt), Gold (Au), and alloys of these materials.

In certain embodiments, each of the one or more heating elements includes at least one of: a grid shaped heating element, a mesh shaped heating element, a net shaped heating element, a spiral heating element, and any combination of these heating elements.

In certain embodiments, each of the one or more cylindrical E-liquid storage media includes at least one of: cotton fibers, polypropylene fibers, terylene fibers, nylon fibers, porous ceramic materials, and any combination of these materials.

In yet another aspect, the present disclosure relates to a method of using an electronic cigarette having a vaporizer assembly with a "U" shaped air path. In certain embodiments, the method includes: filling, by a user, E-liquid into an E-liquid storage tank, and storing the E-liquid in one or more cylindrical E-liquid storage media, sucking, by the user, through an air path of a mouthpiece assembly to generate a negative air pressure in a negative air pressure cavity, turning on an electrical power supply to one or more heating elements of the vaporizer assembly through a negative air pressure activated switch by the negative air pressure generated, and vaporizing, by the one or more heating elements of the vaporizer assembly, the E-liquid stored in the one or more cylindrical E-liquid storage media, and delivering vaporized E-liquid to the user through the "U" shaped air path.

In certain embodiments, the electronic cigarette includes: a mouthpiece assembly, an electronic cigarette body, an E-liquid storage tank, and a vaporizer assembly having a "U" shaped air path. The electronic cigarette body includes a top end, a bottom end and a first air intake opening defined on a first side wall of the electronic cigarette body. The mouthpiece assembly is positioned on the top end of the electronic cigarette body. The E-liquid storage tank is positioned inside of the electronic cigarette body. The E-liquid storage tank includes: an E-liquid storage cavity, the negative air pressure cavity, and a predetermined number of airflow channels. The E-liquid storage cavity stores E-liquid. The predetermined number of airflow channels form the "U" shaped air path outside of the E-liquid storage cavity.

In certain embodiments, the vaporizer assembly includes: one or more cylindrical E-liquid storage media, and one or more heating elements. The one or more cylindrical E-liquid storage media receive and store E-liquid from the E-liquid storage cavity. The one or more heating elements are in direct contact with interior surface of the one or more cylindrical E-liquid storage media to heat the E-liquid received from the E-liquid storage cavity. The one or more heating elements are electrically connected to an electrical power supply through a negative air pressure activated switch.

In certain embodiments, when a user sucks air from the mouthpiece assembly, a negative air pressure is created in the negative air pressure cavity, the negative air pressure activated switch turns on the electrical power supply to the one or more heating elements, and the one or more heating elements vaporize the E-liquid stored in the one or more cylindrical E-liquid storage media to generate electronic cigarette vapor for the user through the "U" shaped air path.

In certain embodiments, the "U" shaped air path includes: a first air intake opening, a second air intake opening, a first airflow channel, a second airflow channel, a third airflow channel, and a fourth airflow channel. The first air intake opening is defined on the first side wall of the electronic cigarette body. The second air intake opening is defined on a first side wall of the E-liquid storage tank. The first airflow channel is positioned on the first side wall of the E-liquid storage tank. A first end of the first airflow channel meets the first air intake opening, the second air intake opening, and the negative air pressure cavity. The second airflow channel is positioned along the one or more cylindrical E-liquid storage media. A first end of the second airflow channel meets a second end of the first airflow channel. The third airflow channel is positioned on an opposite second side of the E-liquid storage tank. A first end of the third airflow channel meets a second end of the second airflow channel. The fourth airflow channel is positioned on a second end of the third airflow channel and a top end of the second side of the E-liquid storage tank. A second end of the fourth airflow channel connects to a mouthpiece air chamber and an air path of the mouthpiece assembly through a mouthpiece air chamber.

In certain embodiments, the mouthpiece assembly includes: the air path, a predetermined number of first mouthpiece connectors, a mouthpiece sealing element, and the mouthpiece air chamber. The air path is positioned inside of the mouthpiece assembly and connects to the "U" shaped air path through the fourth airflow channel in the mouthpiece air chamber for the user to enjoy vaporized E-liquid. The predetermined number of first mouthpiece connectors connect the mouthpiece assembly to the E-liquid storage tank. The mouthpiece sealing element is positioned between the mouthpiece assembly and the E-liquid storage tank to prevent vaporized E-liquid from leaking out of the "U" shaped air path.

In certain embodiments, each of the one or more heating elements includes a positive terminal and a negative terminal. Each of the positive terminals of the one or more heating elements is electrically connected to a positive terminal of the electrical power supply through the negative air pressure activated switch, and each of the negative terminals of the one or more heating elements is electrically connected to a negative terminal of the electrical power supply, respectively.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
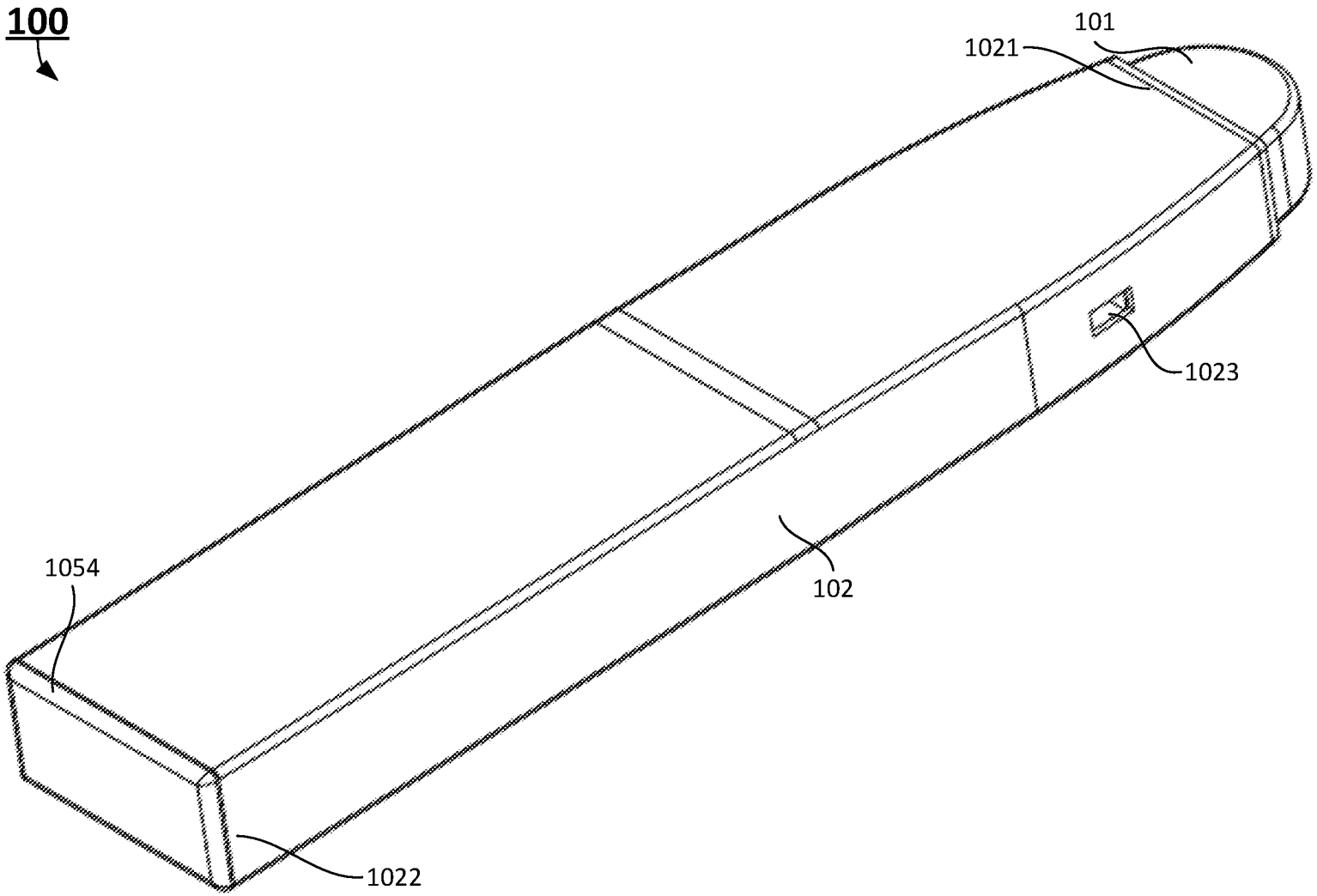
FIG. 1 is a perspective external view of an exemplary electronic cigarette having a vaporizer with a "U" shaped air path according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 7.

Figure 2:
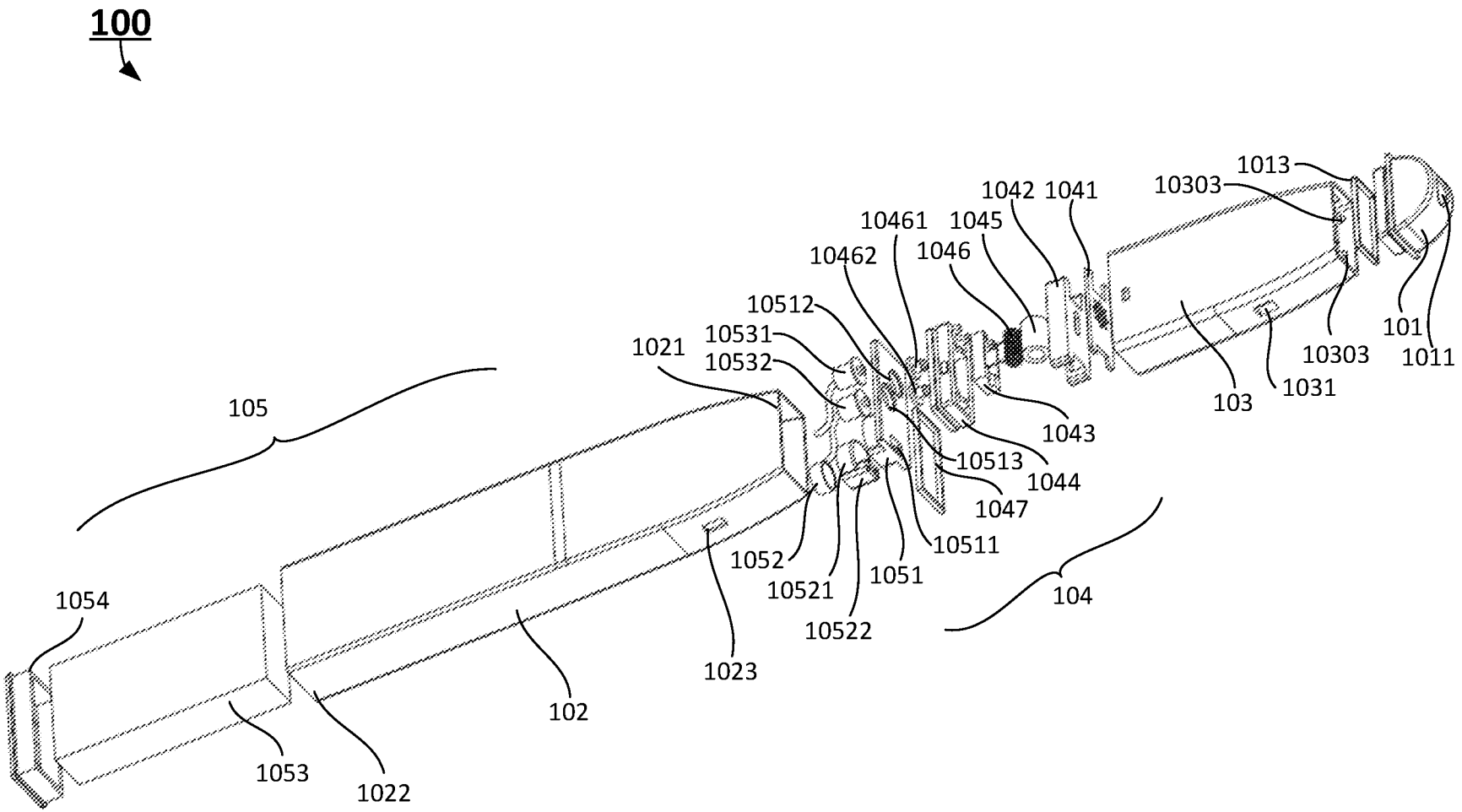
FIG. 2 is an exploded view of the exemplary electronic cigarette having the vaporizer with the "U" shaped air path according to certain embodiments of the present disclosure.
Figure 5:
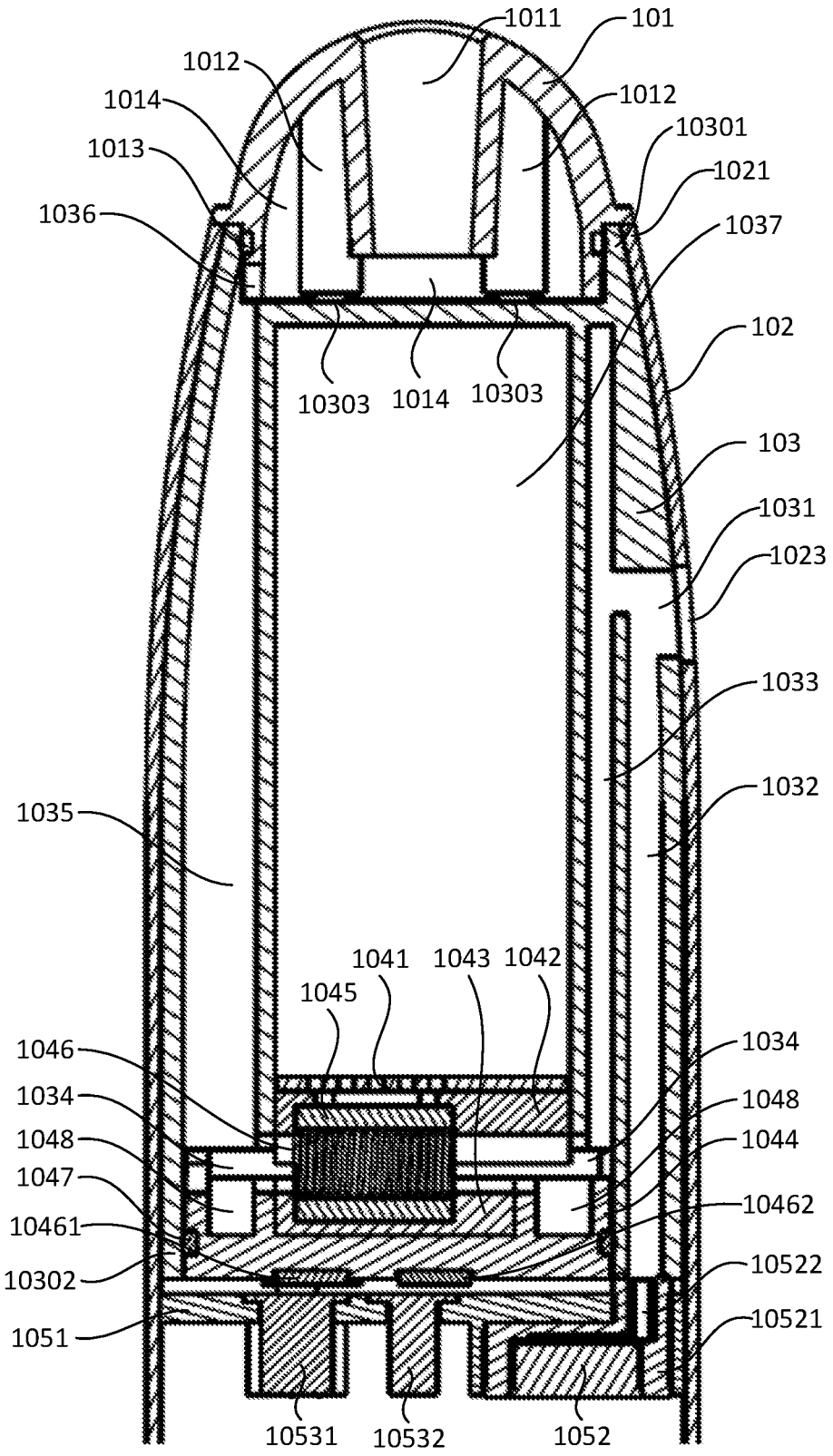
FIG. 5 is a sectional view of the exemplary electronic cigarette having the vaporizer with the "U" shaped air path according to certain embodiments of the present disclosure.

Referring now to FIGS. 2 and 5, an exploded view and a sectional view of an exemplary electronic cigarette 100 having a vaporizer assembly 104 with a "U" shaped air path are shown respectively according to certain embodiments of the present disclosure.

Figure 6:
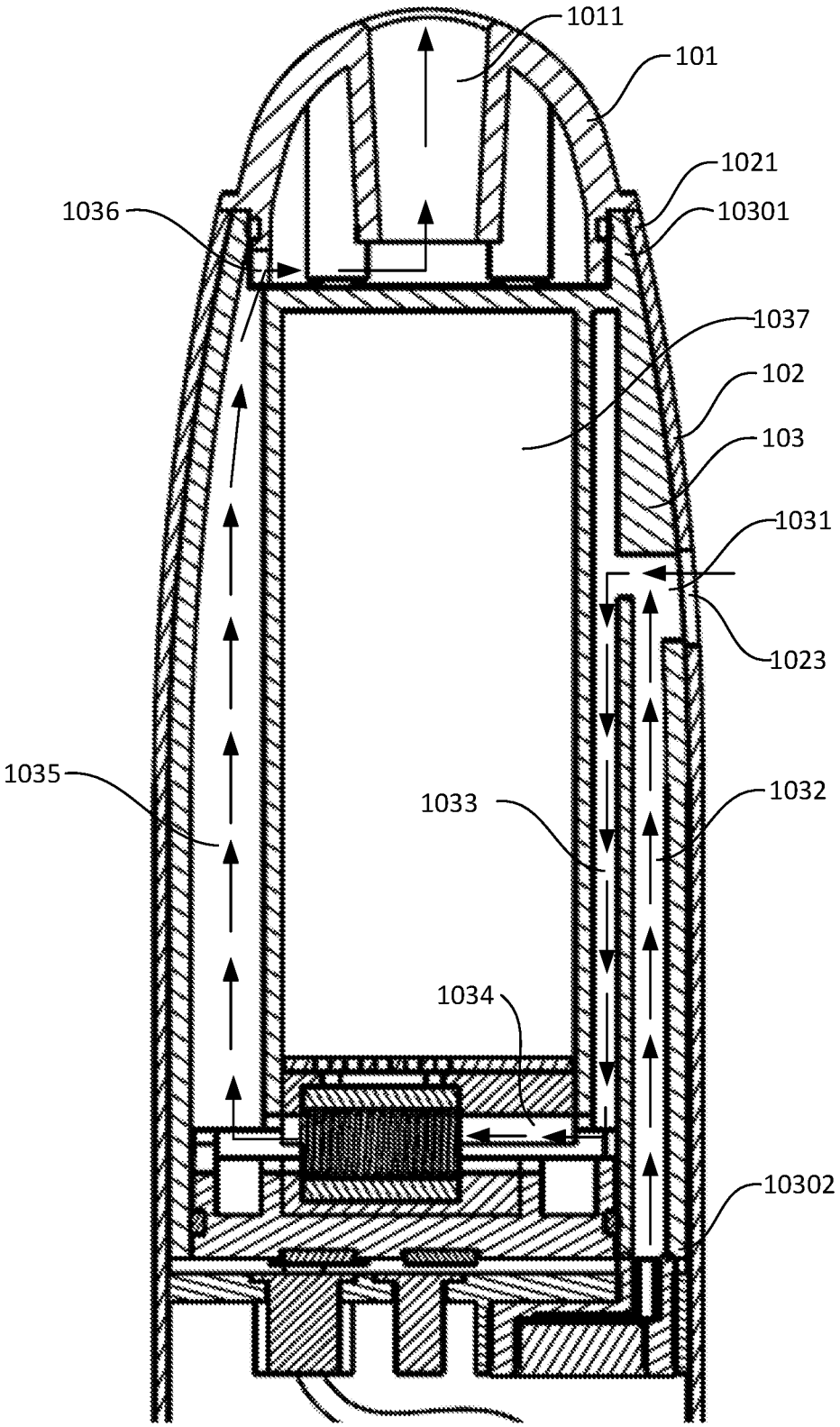
FIG. 6 is a sectional view of the exemplary electronic cigarette showing direction of airflow through the "U" shaped air path according to certain embodiments of the present disclosure.

In one aspect, the present disclosure relates to a vaporizer assembly 104 having the "U" shaped air path as showing in FIG. 5. In certain embodiments, the vaporizer assembly 104 includes: an E-liquid storage tank 103, one or more cylindrical E-liquid storage media 1045, and one or more heating elements 1046. The E-liquid storage tank 103 includes: an E-liquid storage cavity 1037, a negative air pressure cavity 1032, and a predetermined number of airflow channels. The E-liquid storage cavity 1037 of the E-liquid storage tank 103 stores E-liquid for the electronic cigarette 100 as shown in FIGS. 1. The predetermined number of airflow channels form the "U" shaped air path outside of the E-liquid storage cavity 1037 of the E-liquid storage tank 103, as shown in FIG. 6.

In certain embodiments, the "U" shaped air path includes: a first air intake opening 1023 on an electronic cigarette body 102, a second air intake opening 1031 on the E-liquid storage tank 103, a first airflow channel 1033, a second airflow channel 1034, a third airflow channel 1035, and a fourth airflow channel 1036. The first air intake opening 1023 is defined on a first side wall of the electronic cigarette body 102. The second air intake opening 1031 is defined on a first side wall of the E-liquid storage tank 103. The first airflow channel 1033 is positioned on the first side wall of the E-liquid storage tank 103. A first end of the first airflow channel 1033 meets the first air intake opening 1023, the second air intake opening 1031, and the negative air pressure cavity 1032. The second airflow channel 1034 is positioned along the one or more cylindrical E-liquid storage media 1045. A first end of the second airflow channel 1034 meets a second end of the first airflow channel 1033. The third airflow channel 1035 is positioned on an opposite second side of the E-liquid storage tank 103. A first end of the third airflow channel 1035 meets a second end of the second airflow channel 1034. The fourth airflow channel 1036 is positioned on a second end of the third airflow channel 1035 and a top end of the second side of the E-liquid storage tank 103. A second end of the fourth airflow channel 1036 connects to a mouthpiece air chamber 1014 and an air path 1011 of a mouthpiece assembly 101.

In certain embodiments, the one or more cylindrical E-liquid storage media 1045 receives and stores E-liquid from the E-liquid storage cavity 1037 of the E-liquid storage tank 103. The one or more heating elements 1046 are in direct contact with interior surface of the one or more cylindrical E-liquid storage media 1045 to heat and vaporize the E-liquid received from the E-liquid storage tank 103. The one or more heating elements 1046 are electrically connected to an electrical power supply 105 through a negative air pressure activated switch 1052.

In certain embodiments, as shown in FIGS. 2 and 5, the vaporizer assembly 104 is installed on a vaporizer base 1044. In this embodiment, the electronic cigarette 100 includes a heating element 1046, coaxially surrounded by an E-liquid storage medium 1045. The combination of the heating element 1046 and the E-liquid storage medium 1045 are positioned between a first vaporizer support 1042 above and a second vaporizer support 1043 below. An E-liquid storage tank bottom cover 1041 is positioned at the bottom of the E-liquid storage cavity 1037. In one embodiment, the E-liquid storage tank bottom cover 1041 is made in a form of filter to allow the E-liquid in the E-liquid storage tank 103 to flow to the E-liquid storage medium 1045 and to filter out any debris from the E-liquid storage tank 103. A vaporizer sealing ring 1047 is installed between the vaporizer base 1044 and the electronic cigarette body 102 to prevent the vapor leak and E-liquid leak. A condensed water reservoir

1048 is located in the space above the vaporizer base 1044 to collect any condensed water/vapor and to prevent any condensation in the vaporizer assembly 104 from getting into the electrical power supply wiring and the heating elements 1046.

In certain embodiments, when a negative air pressure is created in the negative air pressure cavity 1032, the negative air pressure activated switch 1052 turns on the electrical power supply 105 to the one or more heating elements 1046, and the one or more heating elements 1046 vaporize the E-liquid stored in the one or more cylindrical E-liquid storage media 1045, and deliver vaporized E-liquid to the user through the "U" shaped air path.

In certain embodiments, each of the one or more heating elements 1046 includes a positive terminal 10461 and a negative terminal 10462. The positive terminal 10461 of the one or more heating elements 1046 is electrically connected to a positive terminal 10531 of the electrical power supply 105 through the negative air pressure activated switch 1052. Each of the negative terminals 10462 of the one or more heating elements 1046 is electrically connected to a negative terminal 10532 of the electrical power supply 105.

In certain embodiments, each of the one or more heating elements 1046 includes at least one of: aluminum (Al), Chromium (Cr), Manganese (Mn), Iron (Fe), Cobalt (Co), Nickel (Ni), Copper (Cu), Zirconium (Zr), Niobium (Nb), Molybdenum (Mo), Rhenium (Re), Silver (Ag), Cadmium (Cd), Tantalum (Ta), Tungsten (W), Iridium (Ir), Platinum (Pt), Gold (Au), and alloys of these materials.

In certain embodiments, each of the one or more heating elements 1046 includes at least one of: a grid shaped heating element, a mesh shaped heating element, a net shaped heating element, a spiral heating element, and any combination of these heating elements.

In certain embodiments, each of the one or more cylindrical E-liquid storage media 1045 includes at least one of: cotton fibers, polypropylene fibers, terylene fibers, nylon fibers, porous ceramic materials, and any combination of these materials.

In another aspect, as shown in FIGS. 1-6, the present disclosure relates to an electronic cigarette 100. In certain embodiments, the electronic cigarette 100 includes: a mouthpiece assembly 101, an electronic cigarette body 102, an E-liquid storage tank 103, a vaporizer assembly 104 having a "U" shaped air path, and an electrical power supply 105.

In certain embodiments, the electronic cigarette body 102 includes a top end 1021, a bottom end 1022 and a first air intake opening 1023 defined on a first side wall of the electronic cigarette body 102. The first air intake opening 1023 is the beginning of the "U" shaped air path. The mouthpiece assembly 101 is positioned on the top end 1021 of the electronic cigarette body 102.

Figure 4:
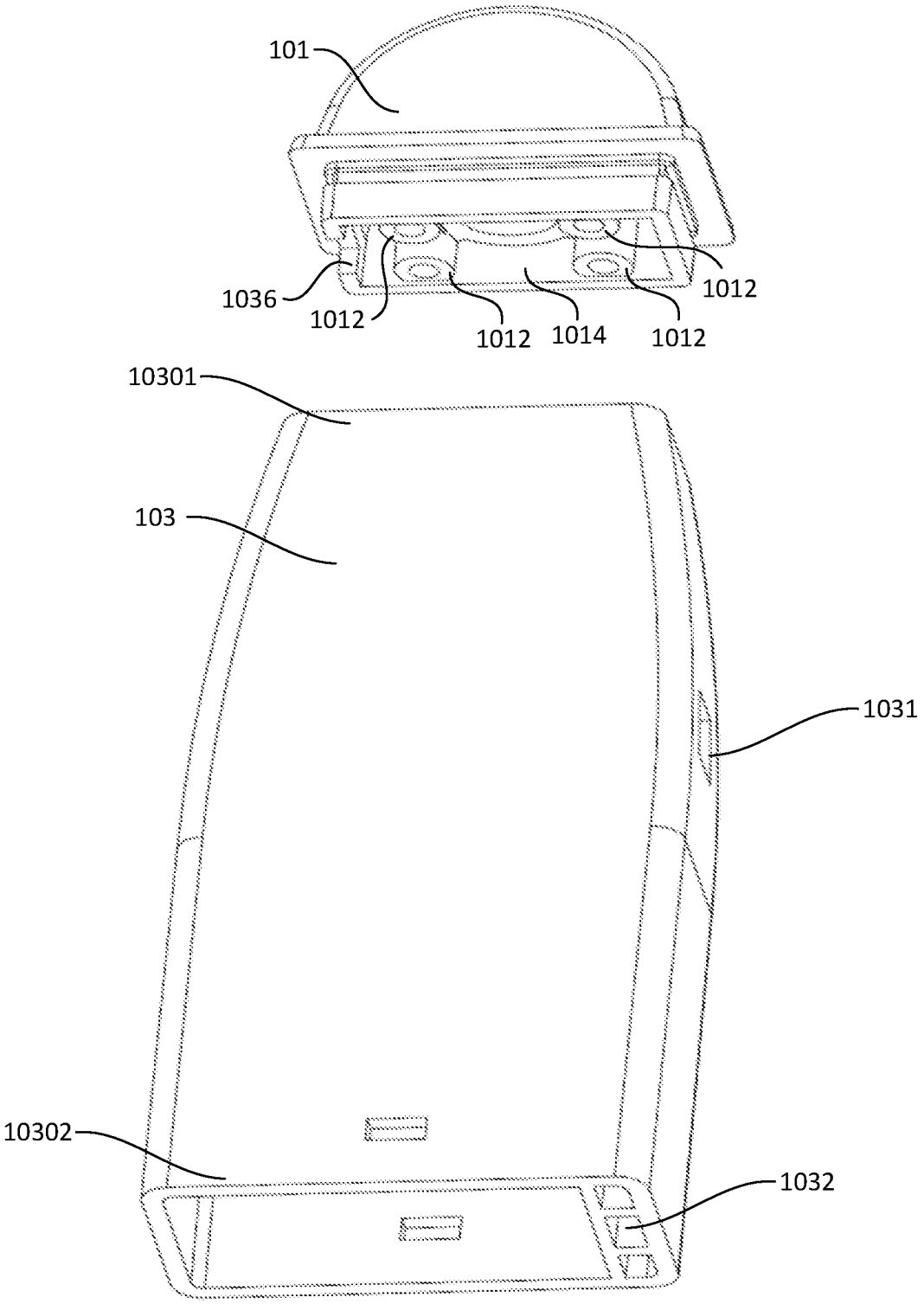
FIG. 4 is a second exploded perspective view of the exemplary electronic cigarette showing connection between the E-liquid storage tank and the mouthpiece assembly according to certain embodiments of the present disclosure.

In certain embodiments, the mouthpiece assembly 101 includes: an air path 1011, a predetermined number of first mouthpiece connectors 1012, a mouthpiece sealing element 1013, and the mouthpiece air chamber 1014. The air path 1011 is positioned inside of the mouthpiece assembly 101 and connects to the "U" shaped air path through the fourth airflow channel 1036 in the mouthpiece air chamber 1014 for the user to enjoy vaporized E-liquid. The predetermined number of first mouthpiece connectors 1012 connect the mouthpiece assembly 101 to the E-liquid storage tank 103. In one embodiment, as shown in FIG. 4, the mouthpiece assembly 101 has four first mouthpiece connectors 1012 in the shape of a tube to fit an equal number of second mouthpiece connectors 10303 positioned on top of the E-liquid storage tank 103. Other methods of connection between the mouthpiece assembly 101 and the E-liquid storage tank 103 are possible, such as frictional connection and magnetic connection.

In certain embodiments, the mouthpiece sealing element 1013 is positioned between the mouthpiece assembly 101 and the E-liquid storage tank 103 to prevent vaporized E-liquid from leaking out of the "U" shaped air path. The mouthpiece air chamber 1014 is located inside of the mouthpiece assembly 101, and connects the fourth airflow channel 1036 and the air path 1011 of the mouthpiece assembly 101.

In certain embodiments, the E-liquid storage tank 103 is positioned inside of the electronic cigarette body 102 as shown in FIG. 5. The E-liquid storage tank 103 includes: an E-liquid storage cavity 1037, a negative air pressure cavity 1032, and a predetermined number of airflow channels. The E-liquid storage cavity 1037 of the E-liquid storage tank 103 stores E-liquid for the electronic cigarette 100 as shown in FIG. 1. The predetermined number of airflow channels form the "U" shaped air path outside of the E-liquid storage cavity 1037 of the E-liquid storage tank 103, as shown in FIG. 6.

Figure 3:
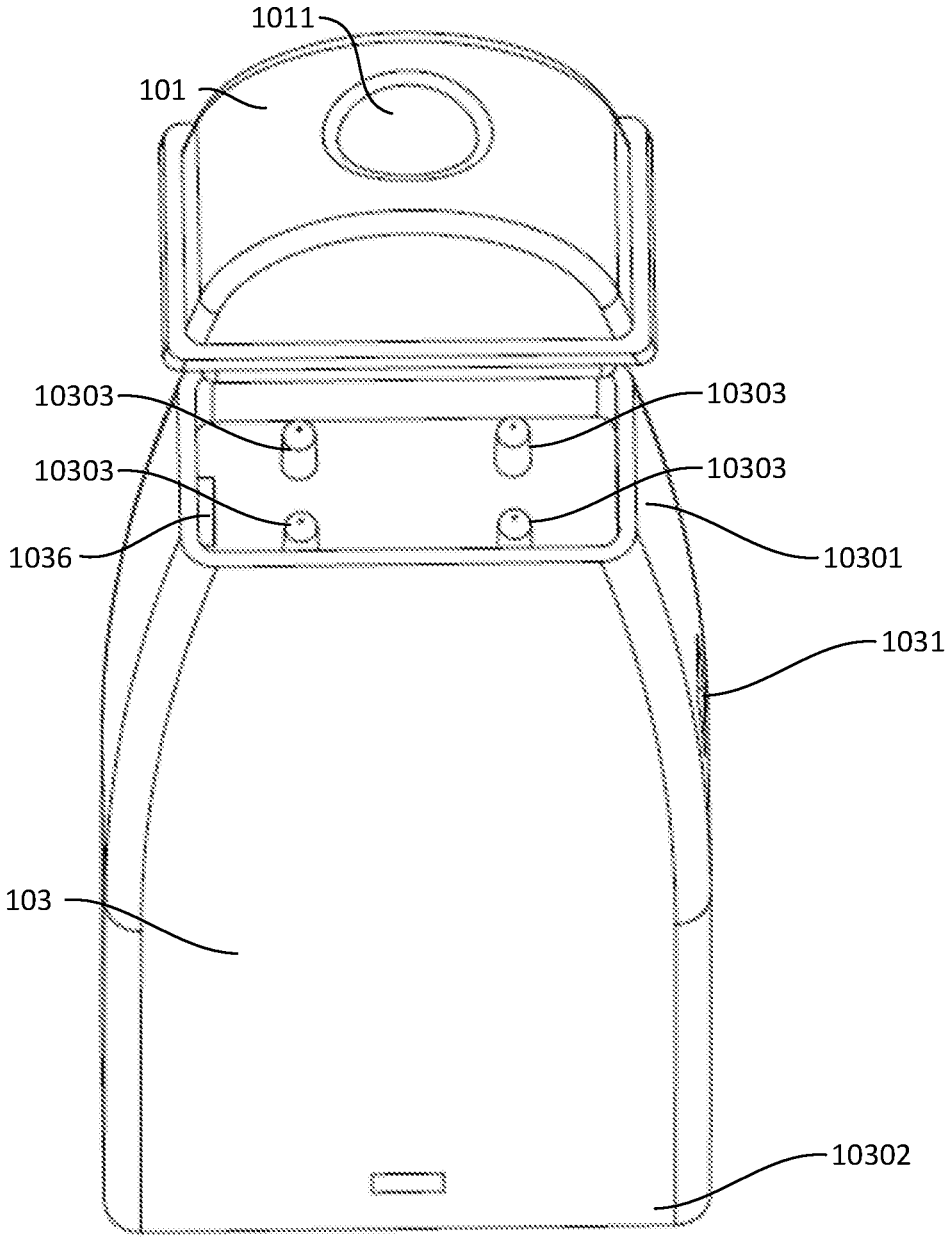
FIG. 3 is a first exploded perspective view of the exemplary electronic cigarette showing connection between an E-liquid storage tank and a mouthpiece assembly according to certain embodiments of the present disclosure.

In certain embodiments, the E-liquid storage tank 103 includes: a top end 10301, a bottom end 10302, and a predetermined number of second mouthpiece connectors 10303. The predetermined number of second mouthpiece connectors 10303 are positioned on the top end 10301 of the E-liquid storage tank 103. In certain embodiments, the number of second mouthpiece connectors 10303 corresponds to the number of first mouthpiece connectors 1012 and each of the second mouthpiece connectors 10303 is connected to a corresponding second mouthpiece connector 1012 of the mouthpiece assembly 101. In one embodiment, as shown in FIGS. 3 and 4, there are four first mouthpiece connectors 1012, and four second mouthpiece connectors 10303. Each of the first mouthpiece connectors 1012 and the second mouthpiece connectors 10303 may be connected in different ways such as frictional connection, and magnetic connection. In one embodiment, as shown in FIGS. 3 and 4, the first mouthpiece connectors 1012 are formed in a tube shape, and the second mouthpiece connectors 10303 are formed in a column shape. The interior diameter of the first mouthpiece connectors 1012 fits the exterior diameter of the second mouthpiece connectors 10303 to connect and hold the mouthpiece assembly 101 on the top end 10301 of the E-liquid storage tank 103.

In certain embodiments, as shown in FIGS. 5 and 6, the "U" shaped air path includes: a first air intake opening 1023 on an electronic cigarette body 102, a second air intake opening 1031 on the E-liquid storage tank 103, a first airflow channel 1033, a second airflow channel 1034, a third airflow channel 1035, and a fourth airflow channel 1036. The first air intake opening 1023 is defined on a first side wall of the electronic cigarette body 102. The second air intake opening 1031 is defined on a first side wall of the E-liquid storage tank 103. The first airflow channel 1033 is positioned on the first side wall of the E-liquid storage tank 103. A first end of the first airflow channel 1033 meets the first air intake opening 1023, the second air intake opening 1031, and the negative air pressure cavity 1032. The second airflow channel 1034 is positioned along the one or more cylindrical E-liquid storage media 1045. A first end of the second airflow channel 1034 meets a second end of the first airflow channel 1033. The third airflow channel 1035 is positioned on an opposite second side of the E-liquid storage tank 103. A first end of the third airflow channel 1035 meets a second end of the second airflow channel 1034. The fourth airflow channel 1036 is positioned on a second end of the third airflow channel 1035 and a top end of the second side of the E-liquid storage tank 103. A second end of the fourth airflow channel 1036 connects to a mouthpiece air chamber 1014 and an air path 1011 of a mouthpiece assembly 101.

In certain embodiments, the vaporizer assembly 104 includes one or more cylindrical E-liquid storage media 1045, and one or more heating elements 1046. The one or more cylindrical E-liquid storage media 1045 receives and stores E-liquid from the E-liquid storage cavity 1037 of the E-liquid storage tank 103. The one or more heating elements 1046 are in direct contact with interior surface of the one or more cylindrical E-liquid storage media 1045 to heat and vaporize the E-liquid received from the E-liquid storage tank 103. In one embodiment, as shown in FIGS. 5 and 6, the E-liquid from the E-liquid storage cavity 1037 flow through an E-liquid storage tank bottom cover 1041 to the one or more cylindrical E-liquid storage media 1045. Each of the one or more cylindrical E-liquid storage media 1045 surrounds a corresponding heating element 1046 and in direct contact with the corresponding heating element 1046.

In certain embodiments, each of the one or more heating elements 1046 includes a positive terminal 10461 and a negative terminal 10462. The positive terminal 10461 of the one or more heating elements 1046 is electrically connected to a positive terminal 10531 of the electrical power supply 105 through the negative air pressure activated switch 1052. Each of the negative terminals 10462 of the one or more heating elements 1046 is electrically connected to a negative terminal 10532 of the electrical power supply 105.

In certain embodiments, as shown in FIG. 6, when a user sucks air from the mouthpiece assembly 101, a negative air pressure is created in the negative air pressure cavity 1032, and outside air enters from the first air intake opening 1023, the second air intake opening 1031, flows through the first airflow channel 1033, the second airflow channel 1034, the third airflow channel 1035, and the fourth airflow channel 1036, and exits from the mouthpiece air chamber 1014 to the mouthpiece air path 1011 to the user.

In certain embodiments, as shown in FIGS. 2 and 5, the vaporizer assembly 104 is installed on a vaporizer base 1044. In this embodiment, the electronic cigarette 100 includes a heating element 1046, coaxially surrounded by an E-liquid storage medium 1045. The combination of the heating element 1046 and the E-liquid storage medium 1045 are positioned between a first vaporizer support 1042 above and a second vaporizer support 1043 below. An E-liquid storage tank bottom cover 1041 is positioned at the bottom of the E-liquid storage cavity 1037. In one embodiment, the E-liquid storage tank bottom cover 1041 is made in a form of filter to allow the E-liquid in the E-liquid storage tank 103 to flow to the E-liquid storage medium 1045 and to filter out any debris from the E-liquid storage tank 103. A vaporizer sealing ring 1047 is installed between the vaporizer base 1044 and the electronic cigarette body 102 to prevent the vapor leak and E-liquid leak. A condensed water reservoir 1048 is located in the space above the vaporizer base 1044 to collect any condensed water/vapor and to prevent any condensation in the vaporizer assembly 104 from getting into the electrical power supply wiring and the heating elements 1046.

In certain embodiments, when a user sucks air from the mouthpiece assembly 101, a negative air pressure is created in the negative air pressure cavity 1032, the negative air pressure created causes the negative air pressure activated switch 1052 to turn on the electrical power supply 105 to the one or more heating elements 1046, and the one or more heating elements 1046 vaporize the E-liquid stored in the one or more cylindrical E-liquid storage media 1045 to generate electronic cigarette vapor for the user through the "U" shaped air path.

In certain embodiments, each of the one or more heating elements 1046 includes at least one of: aluminum (Al), Chromium (Cr), Manganese (Mn), Iron (Fe), Cobalt (Co), Nickel (Ni), Copper (Cu), Zirconium (Zr), Niobium (Nb), Molybdenum (Mo), Rhenium (Re), Silver (Ag), Cadmium (Cd), Tantalum (Ta), Tungsten (W), Iridium (Ir), Platinum (Pt), Gold (Au), and alloys of these materials.

In certain embodiments, each of the one or more heating elements 1046 includes at least one of: a grid shaped heating element, a mesh shaped heating element, a net shaped heating element, a spiral heating element, and any combination of these heating elements.

In certain embodiments, each of the one or more cylindrical E-liquid storage media 1045 includes at least one of: cotton fibers, polypropylene fibers, terylene fibers, nylon fibers, porous ceramic materials, and any combination of these materials.

In certain embodiments, the electronic cigarette 100 is usually used vertically with the mouthpiece assembly on top and the electrical power supply 105 at the bottom. After the vaporizer assembly 104 has been used (vaporizing the E-liquid) for a while and stopped, the heated air and/or vapor inside of the vaporizer assembly 1014 may be condensed and certain E-liquid debris may be accumulated inside of the vaporizer assembly 1014. These condensed water and E-liquid debris may fall into one or more condensed water reservoir 1048 as shown in FIG. 5. Such a construction ensures that the condensed water and E-liquid debris are not in contact with the one or more heating elements 1046, the electrical power supply 105 and electronic switching device to avoid any short circuit of these components.

In certain embodiments, as shown in FIGS. 2, 5 and 6, the electrical power supply 105 includes: a power supply top cover 1051, a negative air pressure activated switch 1052, a battery 1053, and a power supply bottom cover 1054. The power supply top cover 1051 includes a power supply top cover air channel 10511, a positive terminal connection opening 10512 to connect the positive terminal 10531 of the battery 1053 to the positive terminal 10461 of the one or more heating elements 1046, and a negative terminal opening 10513 to connect the negative terminal 10532 of the battery 1053 to the negative terminal 10462 of the one or more heating elements 1046. The negative air pressure activated switch 1052 includes a negative air pressure activated switch support 10521, and a negative air pressure activated switch support air channel 10522. The power supply top cover air channel 10511 and the negative air pressure activated switch support air channel 10522 are connected to the negative air pressure cavity 1032 such that the negative air pressure in the negative air pressure cavity 1032 may be used to activate the negative air pressure activated switch 1052, and the electrical power supply 105 is switched on to power the one or more heating elements 1046. The power supply bottom cover 1054 closes the electronic cigarette body 102 at the bottom end 1022 of the Electronic cigarette body 102.

In certain embodiments, the negative air pressure activated switch 1052 may includes a time delay switch circuit such that when the user stops sucking the air/vapor from the mouthpiece assembly 101, the electrical power supply 105 continues to provide electrical power to the one or more heating elements for a predetermined period of time to ensure vaporizing process is not abruptly stopped and provide the user a smooth and continuous vaporizing experience for the user.

In certain embodiments, the power supply top cover air channel 10511, the negative air pressure activated switch support air channel 10522, and the negative air pressure cavity 1032 are separated from the vaporizer assembly 104 to prevent any condensed water and E-liquid debris from getting into the negative air pressure activated switch 1052.

In yet another aspect, the present disclosure relates to a method of using an electronic cigarette 100 having a vaporizer assembly 104 with a "U" shaped air path. In certain embodiments, the method includes: filling, by a user, E-liquid into an E-liquid storage tank 103, and storing the E-liquid in one or more cylindrical E-liquid storage media 1045, sucking, by the user, through an air path 1011 of a mouthpiece assembly 101 to generate a negative air pressure in a negative air pressure cavity 1032, turning on an electrical power supply 105 to one or more heating elements 1046 of the vaporizer assembly 104 through a negative air pressure activated switch 1052 by the negative air pressure generated, and vaporizing, by the one or more heating elements 1046 of the vaporizer assembly 104, the E-liquid stored in the one or more cylindrical E-liquid storage media 1045, and delivering vaporized E-liquid to the user through the "U" shaped air path.

Figure 7:
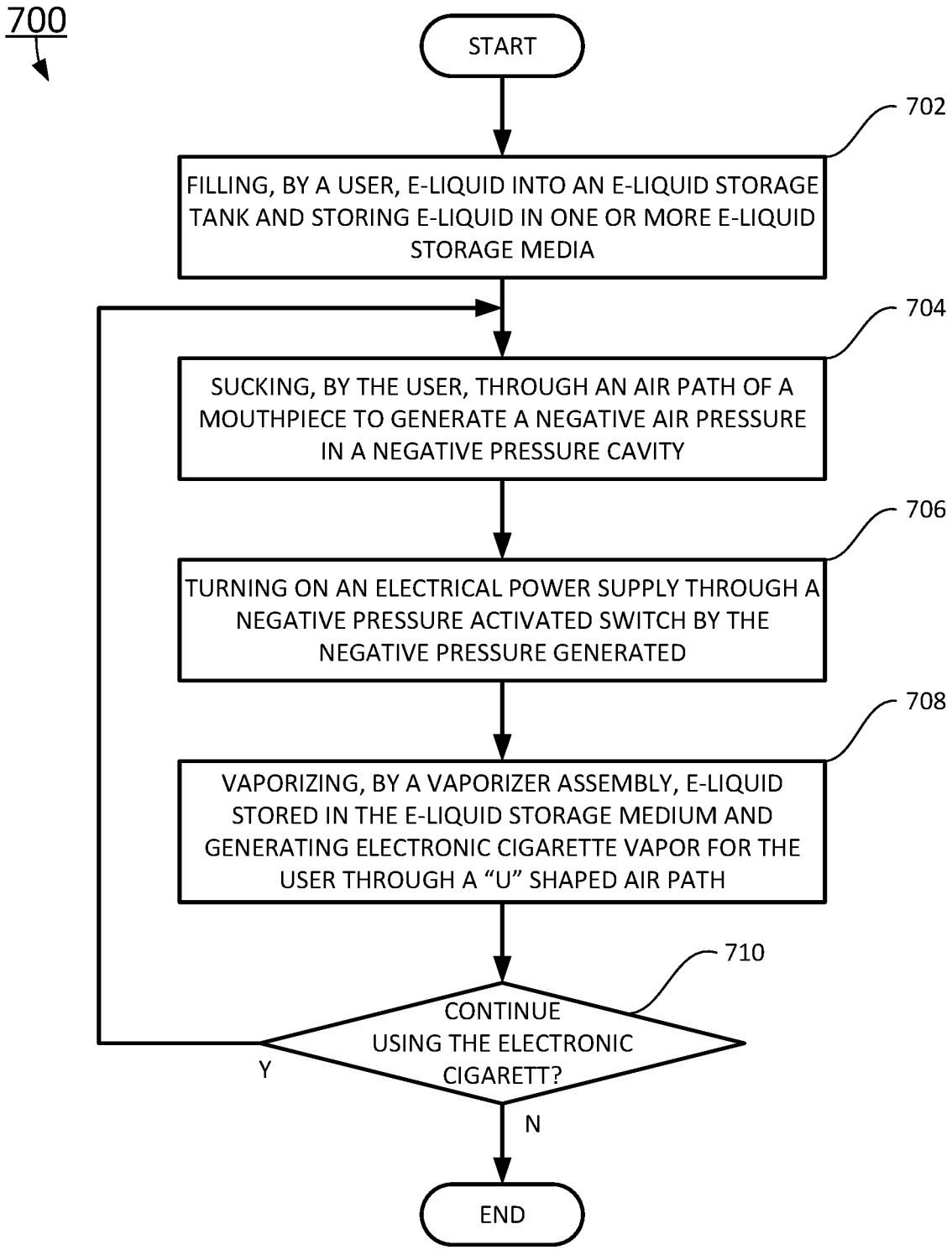
FIG. 7 is a flow chart of an exemplary method of using the electronic cigarette having the vaporizer with the "U" shaped air path according to certain embodiments of the present disclosure.

In certain embodiments, the present disclosure relates to a method 700 of using an electronic cigarette 100 having a vaporizer assembly 104 with the "U" shaped air path, as shown in FIG. 7.

At block 702, the user of the electronic cigarette 100 may fill an E-liquid storage tank 103 of the electronic cigarette 100 with E-liquid. In one embodiment, the E-liquid storage tank 103 is a refillable E-liquid storage tank. An mouthpiece assembly 101 may be removed from a top end 10301 of the E-liquid storage tank 103, and E-liquid may be filled into the E-liquid storage tank 103. In another embodiment, the E-liquid storage tank 103 is not refillable, and the E-liquid storage tank 103 has already been filled with adequate E-liquid.

In certain embodiments, the user may connect the electrical power supply 105 to the electronic cigarette 100. The electrical power supply 105 may be a battery 1053, or a rechargeable battery 1053. The battery 1053 includes a positive terminal 10531 and a negative terminal 10532. The positive terminal 10531 of the electrical power supply 105 is electrically connected to a positive terminal 10461 of one or more heating elements 1046, and the negative terminal 10532 of the electrical power supply 105 is electrically connected to a negative terminal 10462 of one or more heating elements 1046 of the electronic cigarette 100.

At block 704, the user sucks air from the air path 1011 of the mouthpiece assembly 101. The air path 1011 is a part of the "U" shaped air path. The user's suction of the air through the "U" shaped air path generates a negative air pressure in the negative air pressure cavity 1032.

In certain embodiments, as shown in FIGS. 5 and 6, the "U" shaped air path includes: a first air intake opening 1023 on an electronic cigarette body 102, a second air intake opening 1031 on the E-liquid storage tank 103, a first airflow channel 1033, a second airflow channel 1034, a third airflow channel 1035, and a fourth airflow channel 1036. The first air intake opening 1023 is defined on a first side wall of the electronic cigarette body 102. The second air intake opening 1031 is defined on a first side wall of the E-liquid storage tank 103. The first airflow channel 1033 is positioned on the first side wall of the E-liquid storage tank 103. A first end of the first airflow channel 1033 meets the first air intake opening 1023, the second air intake opening 1031, and the negative air pressure cavity 1032. The second airflow channel 1034 is positioned along the one or more cylindrical E-liquid storage media 1045. A first end of the second airflow channel 1034 meets a second end of the first airflow channel 1033. The third airflow channel 1035 is positioned on an opposite second side of the E-liquid storage tank 103. A first end of the third airflow channel 1035 meets a second end of the second airflow channel 1034. The fourth airflow channel 1036 is positioned on a second end of the third airflow channel 1035 and a top end of the second side of the E-liquid storage tank 103. A second end of the fourth airflow channel 1036 connects to a mouthpiece air chamber 1014 and an air path 1011 of the mouthpiece assembly 101.

At block 706, the negative air pressure generated in the negative air pressure cavity 1032 causes the negative air pressure activated switch 1052 to turn on the electrical power supply 105 to the one or more heating elements 1046 of the vaporizer assembly 104.

At block 708, when the negative air pressure activated switch 1052 turns on the electrical power supply 105 to the one or more heating elements 1046 of the vaporizer assembly 104, the one or more heating elements 1046 vaporize E-liquid stored in one or more E-liquid storage media 1045, generate vaporized E-liquid and provide the vaporized E-liquid generated to the user through the "U" shaped air path.

At query block 710, the user decides whether he/she wants to continue using the electronic cigarette 100. When the user decides to continue using the electronic cigarette 100, the method proceeds to block 704. Otherwise, the method proceeds to the end. One of the advantages of the electronic cigarette 100 having the vaporizer assembly 104 with the "U" shaped air path is that once the user stops sucking the air/vapor from the mouthpiece assembly 101, the electrical power supply 105 to the one or more heating elements 1046 will be turned off.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. A vaporizer assembly having a "U" shaped air path, comprising:

an E-liquid storage tank, wherein the E-liquid storage tank comprises: an E-liquid storage cavity for storing E-liquid, a negative air pressure cavity, and a plurality of airflow channels forming the "U" shaped air path outside of the E-liquid storage cavity;

one or more cylindrical E-liquid storage media for receiving and storing E-liquid from the E-liquid storage cavity; and one or more heating elements in direct contact with interior surface of the one or more cylindrical E-liquid storage media to heat the E-liquid received from the E-liquid storage tank, wherein the one or more heating elements are electrically connected to an electrical power supply through a negative air pressure activated switch, wherein when a negative air pressure is created in the negative air pressure cavity, the negative air pressure activated switch turns on the electrical power supply to the one or more heating elements, and the one or more heating elements vaporize the E-liquid stored in the one or more cylindrical E-liquid storage media, and deliver vaporized E-liquid to the user through the "U" shaped air path.

2. The vaporizer assembly of claim 1, wherein the "U" shaped air path comprises:

a first air intake opening defined on a first side wall of an electronic cigarette body;

a second air intake opening defined on a first side wall of the E-liquid storage tank;

a first airflow channel positioned on the first side wall of the E-liquid storage tank, wherein a first end of the first airflow channel meets the first air intake opening, the second air intake opening, and the negative air pressure cavity;

a second airflow channel positioned along the one or more cylindrical E-liquid storage media, wherein a first end of the second airflow channel meets a second end of the first airflow channel;

a third airflow channel positioned on an opposite second side of the E-liquid storage tank, wherein a first end of the third airflow channel meets a second end of the second airflow channel; and a fourth airflow channel positioned on a second end of the third airflow channel and a top end of the second side of the E-liquid storage tank, wherein a second end of the fourth airflow channel connects to an air path of a mouthpiece assembly through a mouthpiece air chamber.

3. The vaporizer assembly of claim 1, wherein each of the one or more heating elements comprises a positive terminal and a negative terminal, wherein each of the positive terminals of the one or more heating elements is electrically connected to a positive terminal of the electrical power supply through the negative air pressure activated switch in serial, and each of the negative terminals of the one or more heating elements is electrically connected to a negative terminal of the electrical power supply.

4. The vaporizer assembly of claim 1, wherein each of the one or more heating elements comprises at least one of:

aluminum (Al);
Chromium (Cr);
Manganese (Mn);
Iron (Fe);
Cobalt (Co);
Nickel (Ni);
Copper (Cu);
Zirconium (Zr);
Niobium (Nb);
Molybdenum (Mo);
Rhenium (Re);
Silver (Ag);
Cadmium (Cd);
Tantalum (Ta);
Tungsten (W);
Iridium (Ir);
Platinum (Pt);
Gold (Au); and
alloys thereof.

5. The vaporizer assembly of claim 1, wherein each of the one or more heating elements comprises at least one of:

a grid shaped heating element;
a mesh shaped heating element;
a net shaped heating element;
a spiral heating element; and
any combination thereof.

6. The vaporizer assembly of claim 1, wherein each of the one or more cylindrical E-liquid storage media comprises at least one of:

cotton fibers;
polypropylene fibers;
terylene fibers;
nylon fibers;
porous ceramic materials; and
any combination thereof.

7. An electronic cigarette comprising the vaporizer assembly of claim 1.

8. An electronic cigarette comprising:

an electronic cigarette body having a top end, a bottom end and a first air intake opening defined on a first side wall of the electronic cigarette body;

a mouthpiece assembly positioned on the top end of the electronic cigarette body;

an E-liquid storage tank positioned inside of the electronic cigarette body, wherein the E-liquid storage tank comprises: an E-liquid storage cavity for storing E-liquid, a negative air pressure cavity, and a plurality of airflow channels forming a "U" shaped air path outside of the E-liquid storage cavity; and a vaporizer assembly wherein the vaporizer assembly comprises: one or more cylindrical E-liquid storage media for receiving and storing E-liquid from the E-liquid storage cavity, one or more heating elements in direct contact with interior surface of the one or more cylindrical E-liquid storage media to heat the E-liquid received from the E-liquid storage cavity, wherein the one or more heating elements are electrically connected to an electrical power supply through a negative air pressure activated switch, wherein when a user sucks air from the mouthpiece assembly, a negative air pressure is created in the negative air pressure cavity, the negative air pressure activated switch turns on the electrical power supply to the one or more heating elements, and the one or more heating elements vaporize the E-liquid stored in the one or more cylindrical E-liquid storage media to generate electronic cigarette vapor for the user through the "U" shaped air path.

9. The electronic cigarette of claim 8, wherein each of the one or more heating elements comprises a positive terminal and a negative terminal, wherein each of the positive terminals of the one or more heating elements is electrically connected to a positive terminal of the electrical power supply through the negative air pressure activated switch in serial, and each of the negative terminals of the one or more heating elements is electrically connected to a negative terminal of the electrical power supply, respectively.

10. The electronic cigarette of claim 8, wherein the "U" shaped air path comprises:

the first air intake opening defined on the first side wall of the electronic cigarette body;

a second air intake opening defined on a first side wall of the E-liquid storage tank;

a first airflow channel positioned on the first side wall of the E-liquid storage tank, wherein a first end of the first airflow channel meets the first air intake opening, the second air intake opening, and the negative air pressure cavity;

a second airflow channel positioned along the one or more cylindrical E-liquid storage media, wherein a first end of the second airflow channel meets a second end of the first airflow channel;

a third airflow channel positioned on an opposite second side of the E-liquid storage tank, wherein a first end of the third airflow channel meets a second end of the second airflow channel; and a fourth airflow channel positioned on a second end of the third airflow channel and a top end of the second side of the E-liquid storage tank, wherein a second end of the fourth airflow channel connects to an air path of a mouthpiece assembly through a mouthpiece air chamber.

11. The electronic cigarette of claim 10, wherein the mouthpiece assembly comprises:

a mouthpiece air chamber inside of the mouthpiece assembly;

the air path connected to the "U" shaped air path through the fourth airflow channel in the mouthpiece air chamber for the user to enjoy vaporized E-liquid;

a plurality of first mouthpiece connectors for connecting the mouthpiece assembly to the E-liquid storage tank; and a mouthpiece sealing element positioned between the mouthpiece assembly and the E-liquid storage tank.

12. The electronic cigarette of claim 11, wherein the E-liquid storage tank comprises:

the second air intake opening defined on the first side wall of the E-liquid storage tank;

a top end and a bottom end; and a plurality of second mouthpiece connectors positioned on the top end of the E-liquid storage tank, wherein each of the plurality of second mouthpiece connectors is connected to a corresponding second mouthpiece connector of the mouthpiece assembly.

13. The electronic cigarette of claim 8, wherein each of the one or more heating elements comprises at least one of:

aluminum (Al);
Chromium (Cr);
Manganese (Mn);
Iron (Fe);
Cobalt (Co);
Nickel (Ni);
Copper (Cu);
Zirconium (Zr);
Niobium (Nb);
Molybdenum (Mo);
Rhenium (Re);
Silver (Ag);
Cadmium (Cd);
Tantalum (Ta);
Tungsten (W);
Iridium (Ir);
Platinum (Pt);
Gold (Au); and
alloys thereof.

14. The electronic cigarette of claim 8, wherein each of the one or more heating elements comprises at least one of:

a grid shaped heating element;
a mesh shaped heating element;
a net shaped heating element;
a spiral heating element; and
any combination thereof.

15. The electronic cigarette of claim 8, wherein each of the one or more cylindrical E-liquid storage media comprises at least one of:

cotton fibers;
polypropylene fibers;
terylene fibers;
nylon fibers;
porous ceramic materials; and
any combination thereof.

16. A method of using an electronic cigarette having a vaporizer assembly with a "U" shaped air path, comprising:

filling, by a user, E-liquid into an E-liquid storage tank, and storing the E-liquid in one or more cylindrical E-liquid storage media;

sucking, by the user, through an air path of a mouthpiece assembly to generate a negative air pressure in a negative air pressure cavity;

turning on an electrical power supply to one or more heating elements of the vaporizer assembly through a negative air pressure activated switch by the negative air pressure generated; and vaporizing, by the one or more heating elements of the vaporizer assembly, the E-liquid stored in the one or more cylindrical E-liquid storage media, and delivering vaporized E-liquid to the user through the "U" shaped air path.

17. The method of claim 16, wherein the electronic cigarette comprises:

an electronic cigarette body having a top end, a bottom end and a first air intake opening defined on a first side wall of the electronic cigarette body;

the mouthpiece assembly positioned on the top end of the electronic cigarette body;

the E-liquid storage tank positioned inside of the electronic cigarette body, wherein the E-liquid storage tank comprises: an E-liquid storage cavity for storing E-liquid, the negative air pressure cavity, and a plurality of airflow channels forming the "U" shaped air path outside of the E-liquid storage cavity; and the vaporizer assembly wherein the vaporizer assembly comprises: the one or more cylindrical E-liquid storage media for receiving and storing E-liquid from the E-liquid storage cavity, the one or more heating elements in direct contact with interior surface of the one or more cylindrical E-liquid storage media to heat the E-liquid received from the E-liquid storage cavity, wherein the one or more heating elements are electrically connected to the electrical power supply through the negative air pressure activated switch, wherein when the user sucks air from the mouthpiece assembly, a negative air pressure is created in the negative air pressure cavity, the negative air pressure activated switch turns on the electrical power supply to the one or more heating elements, and the one or more heating elements vaporize the E-liquid stored in the one or more cylindrical E-liquid storage media to generate electronic cigarette vapor for the user through the "U" shaped air path.

18. The method of claim 17, wherein the "U" shaped air path comprises:

the first air intake opening defined on the first side wall of the electronic cigarette body;

a second air intake opening defined on a first side wall of the E-liquid storage tank;

a first airflow channel positioned on the first side wall of the E-liquid storage tank, wherein a first end of the first airflow channel meets the first air intake opening, the second air intake opening, and the negative air pressure cavity;

a second airflow channel positioned along the one or more cylindrical E-liquid storage media, wherein a first end of the second airflow channel meets a second end of the first airflow channel;

a third airflow channel positioned on an opposite second side of the E-liquid storage tank, wherein a first end of the third airflow channel meets a second end of the second airflow channel;

a fourth airflow channel positioned on a second end of the third airflow channel and a top end of the second side of the E-liquid storage tank, wherein a second end of the fourth airflow channel connects to an air path of a mouthpiece assembly through a mouthpiece air chamber.

19. The method of claim 18, wherein the mouthpiece assembly comprises:

the mouthpiece air chamber inside of the mouthpiece assembly;

the air path connected to the "U" shaped air path through the fourth airflow channel in the mouthpiece air chamber for the user to enjoy vaporized E-liquid;

a plurality of first mouthpiece connectors for connecting the mouthpiece assembly to the E-liquid storage tank; and a mouthpiece sealing element positioned between the mouthpiece assembly and the E-liquid storage tank.

20. The method of claim 16, wherein each of the one or more heating elements comprises a positive terminal and a negative terminal, wherein each of the positive terminals of the one or more heating elements is electrically connected to a positive terminal of the electrical power supply through the negative air pressure activated switch in serial, and each of the negative terminals of the one or more heating elements is electrically connected to a negative terminal of the electrical power supply, respectively.

* * * * *